United States Patent [19]

Patz

[11] 4,030,056

[45] June 14, 1977

[54] CORE FOR AN ELECTROMAGNET HAVING SHADING COILS CAST IN SITU

[75] Inventor: Roman J. Patz, Wauwatosa, Wis.

[73] Assignee: Cutler-Hammer, Inc., Milwaukee, Wis.

[22] Filed: Nov. 19, 1975

[21] Appl. No.: 633,389

[52] U.S. Cl. ..... 335/245; 310/172
[51] Int. Cl.[2] ..... H01F 7/10; H01F 7/12
[58] Field of Search ..... 335/243, 245, 247, 104; 29/527.5; 164/109, 111; 310/172

[56] References Cited

UNITED STATES PATENTS

| | | | |
|---|---|---|---|
| 2,456,394 | 12/1948 | Fisher | 335/245 |
| 2,516,603 | 7/1950 | Soreng et al. | 335/245 |
| 3,535,568 | 10/1970 | Haverkamp | 310/172 X |

FOREIGN PATENTS OR APPLICATIONS

| | | | |
|---|---|---|---|
| 603,759 | 6/1948 | United Kingdom | 335/245 |

OTHER PUBLICATIONS

Electro Magnetic Switches, by N. Togami, Denki University Press, Tokyo, Jan. 15, 1962.

*Primary Examiner*—George Harris
*Attorney, Agent, or Firm*—Hugh R. Rather; William A. Autio; Michael E. Taken

[57] ABSTRACT

A laminated core for an A.C. electromagnet comprising its own die for the casting of shading coils therein. Retention grooves formed across the laminations and retention slots formed in side plates provide a continuous path for the injection of molten metal therein, thereby producing a closed-loop shading coil when solidified. Also disclosed is a method for making a core having a shading coil cast in situ.

4 Claims, 6 Drawing Figures

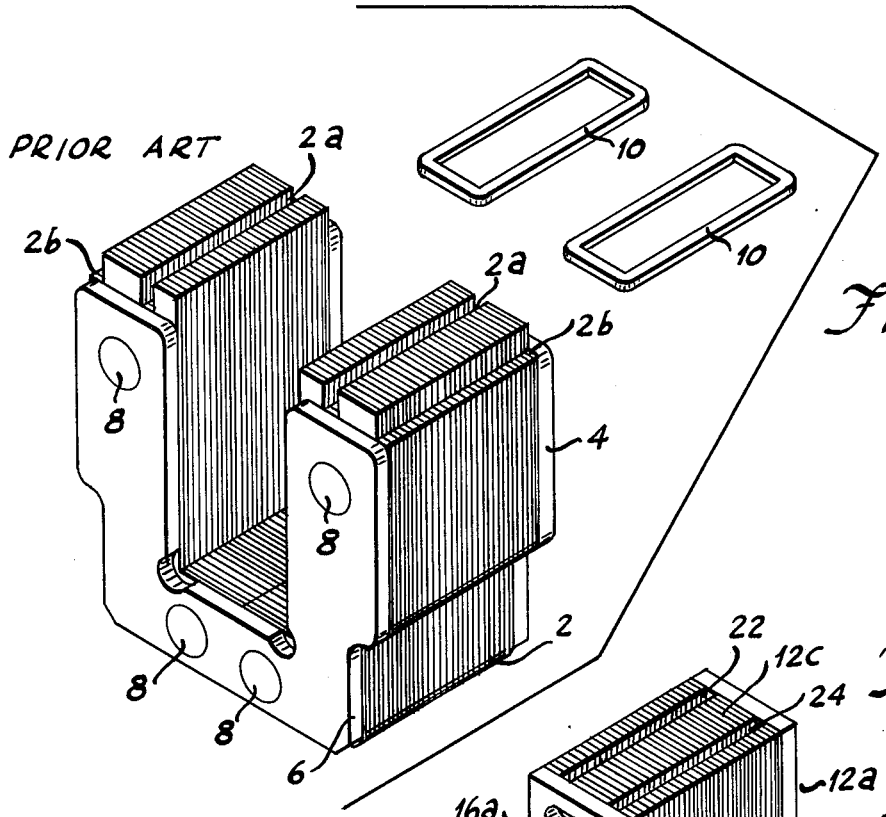
Fig. 1
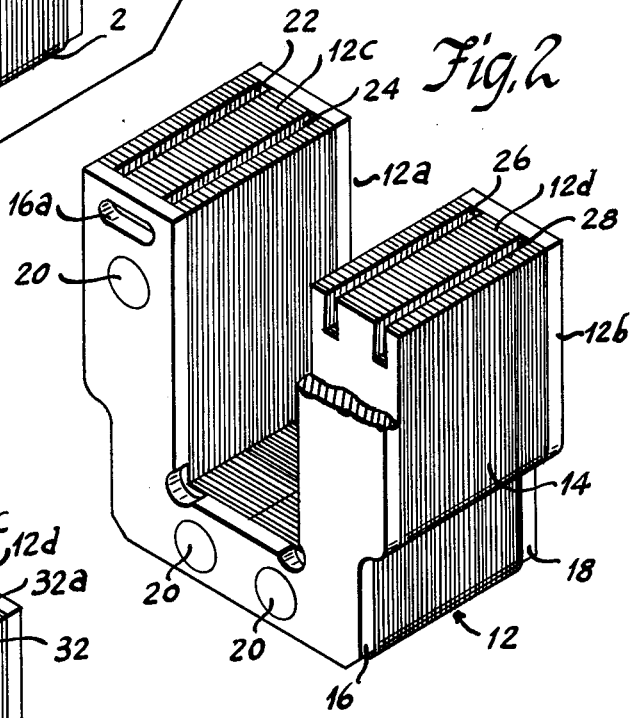
Fig. 2
Fig. 3
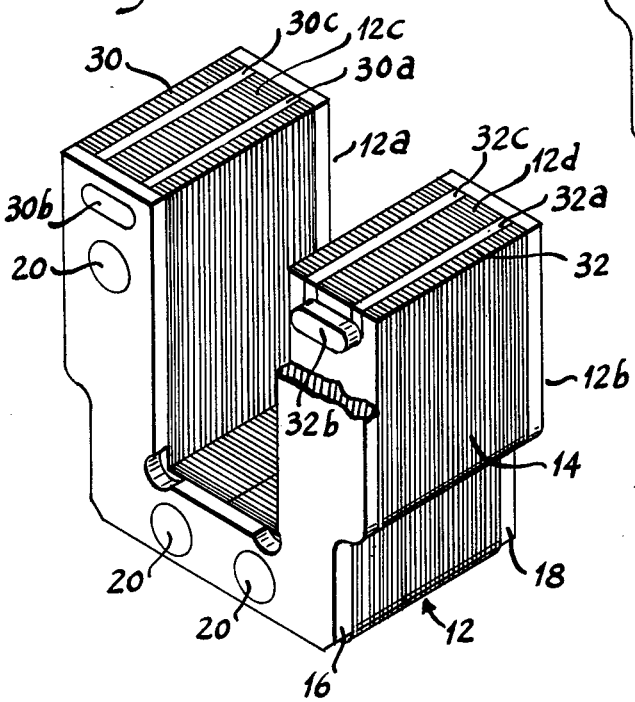

CORE FOR AN ELECTROMAGNET HAVING SHADING COILS CAST IN SITU

BACKGROUND OF THE INVENTION

Electromagnet cores having shading coils are known in the prior art. Such coils are desirable in A.C. electromagnets to diminish chattering and noise by preventing the flux from dropping to zero.

These coils, commonly made of copper, are preformed and the pre-forming process leaves much scrap as waste. A compound die first punches out a rectangular blank and then punches a rectangular aperture in the blank. The forming punch has a rectangular shell-like configuration which is subject to frequent breaking, requiring replacement, thus resulting in high cost tooling and tool maintenance. These coils must be affixed to the core in some manner and this involves extra assembly steps wherein the coil must be handled, placed on the core, and staked or cemented.

SUMMARY OF THE INVENTION

The present invention eliminates the above noted and other disadvantages by using the core itself as a die for integrally forming and permanently securing a shading coil cast in situ. Electrically conductive zinc, lead or any other comparable low melting point metal may be used, thus reducing tool cost and material cost and eliminating waste. Mechanical interlocking of the die-cast metal to the core provides greater retentive strength than adhesion or staking of a prior coil. A number of assembly steps are replaced by a single casting step.

It is therefore an object of the invention to provide an improved shaded-pole core for an electromagnet.

Another object of the invention is to provide a core for an electromagnet having a closed-loop shading coil cast in situ on a pole piece of the core.

Another object of the invention is to provide a method for making a shaded-pole core of the aforementioned character.

Another object of the invention is to provide a core of the aforementioned character which can be more economically manufactured than heretobefore.

Another object of the invention is to provide a core of the aforementioned character providing a shading coil of greater retentive strength due to mechanical interlocking of the die-cast metal to the core.

Another object of the invention is to provide a core of the aforementioned character affording quieter operation because of a smoother pole face due to minute particle migration of the die-cast metal into cracks between the lamina of a laminated core.

Other objects of the invention will hereinafter appear.

BRIEF DESCRIPTION OF THE DRAWINGS

FIG. 1 is an exploded isometric view of a prior core for an electromagnet showing the shading coils removed therefrom.

FIG. 2 is an isometric view of a magnetizable core constructed in accordance with the invention wherein one of the side plates is partially cut away to show the grooves into which the shading coil is to be cast.

FIG. 3 is a view like FIG. 2 but showing shading coils cast in place.

DESCRIPTION OF THE PRIOR ART

Figure 4:
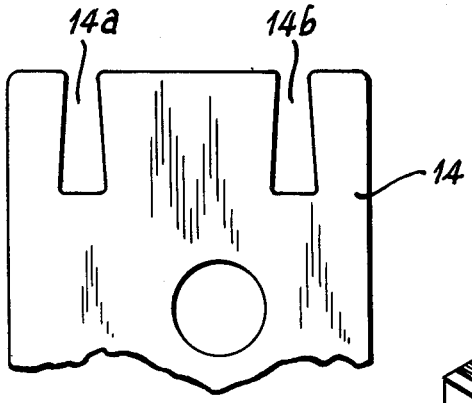
FIG. 4 is a fragmentary elevational view of one lamination of FIG. 2 showing the constricted configuration of the grooves.

There is shown in FIG. 1, a U-shaped laminated core for an A.C. electromagnet known in the prior art. A stack of magnetizable laminations 2 is supported between side plates 4 and 6 by rivets 8 in a known manner. The tops of the laminations extend beyond the side plates and form the pole faces of the core. Each pole face has grooves **2*a* and 2*b* formed therein for receiving a shading coil 10**.

These shading coils are usually pre-formed and such a process wastes much of the material between formations, rendering it scrap. These coils must be affixed to the poles of the core in some manner, such as by an adhesive or by staking. This requires extra assembly steps, such as handling, placement, post-attachment removal of excess adhesive and oven baking of the remaining adhesive. Furthermore, an adhesive may not supply the necessary bonding strength to prevent coil dislodgement after prolonged use.

DESCRIPTION OF THE PREFERRED EMBODIMENT

There is shown in FIGS. 2 and 3 a core 12 constructed in accordance with the present invention. This core is U-shaped and has a pair of pole pieces **12*a* and 12*b* formed by the legs of the U. The top surfaces of these pole pieces are flat to provide pole faces 12*c* and 12*d*** for engagement from above by a vertically reciprocal movable armature or the like (not shown).

The core comprises a stack of contiguous coextensive U-shaped iron laminations 14 and a pair of U-shaped stainless steel side plates 16 and 18 contiguous to and coextensive with the outermost laminations. Rivets 20 extend through the side plates and the laminations to provide rigid securement thereof.

Each lamination has a pair of spaced notches formed on the end of the legs of the U. Notches **14*a* and 14*b* in the right leg of a lamination are shown in FIG. 4. These notches are narrower at the top open end than at the bottom closed end in order to provide constriction means for retaining the coil. The notches are similarly formed in all the laminations and thus are aligned when the laminations are stacked to cumulatively form a pair of parallel spaced grooves 22 and 24 in pole face 12*c* and 26 and 28 in pole face 12*d***, FIG. 2, extending transversely across all of the laminations. Referring to FIG. 4, many other constriction means are possible, such as bumps or detents in the side walls of the notches, etc.

The side walls 16 and 18 extend up to be flush with the pole faces. Each side plate has a pair of elongated slots or apertures (only slot **16*a* is shown, FIG. 2) formed therein, one near each end of the legs of the U, adjacent the pole pieces. These slots are in communication with the grooves to thereby form a continuous path about each pole piece. As shown in FIG. 2, a continuous path is formed by groove 24, slot 16***a*, groove 22, and a slot like 16*a* (not shown) in the side plate 18.

Molten metal such as zinc, lead or any other comparable low melting point metal, is cast into the grooves and slots about each pole piece to form, when solidified, shading coils 30 and 32, FIG. 3. Shading coil 32 is a closed electrically conductive loop comprised by the segments 32*a*, 32*b*, 32*c*, and a segment like 32*b* (not shown) situate in the slot in side plate 18. Shading coil 30 is similar, comprised by segments 30*a*, 30*b* (situate in slot 16*a*), 30*c*, and a segment like 30*b* (not shown) situate in the slot in side plate 18.

Grooves 22, 24 and 26, 28 are formed internal to the edges of the pole face to prevent chipping of the shading coil segments 30*c*, 30*a* and 32*c*, 32*a*. Repeated blows from above by an armature (not shown) against the pole faces could cause chipping or loosening of the segments if the grooves were formed on the edges of the pole faces. The slots are formed below the tops of the side plates to prevent chipping and loosening of segments 30*b* and 32*b* and those segments situate in the slots in side plate 18. The constriction provided by the shape of the grooves, FIG. 4, together with the slots provide locking means to retain the shading coils in rigid permanent securement on the core 12.

Figure 5:
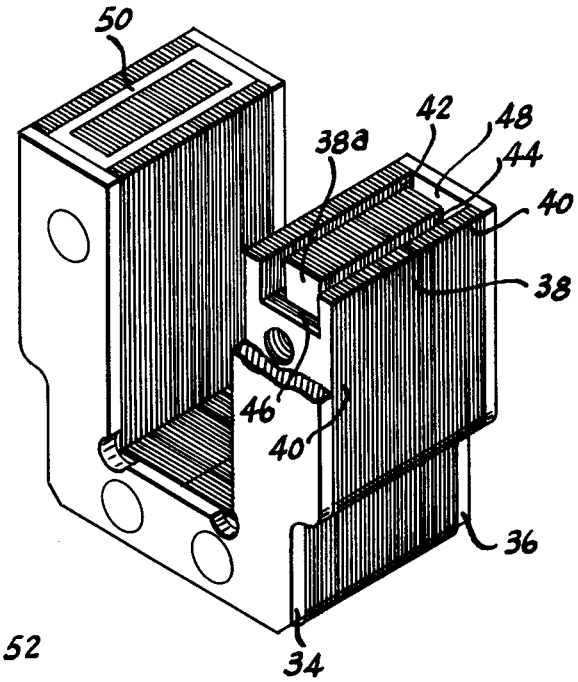
FIG. 5 is an isometric view, with one of the side plates partially cut away, of an alternate embodiment of a magnetizable core having a modified groove for the shading coil.

There is shown in FIG. 5 an alternate embodiment of the present invention wherein the shading coils are cast solely in the laminations, there being no slots in side plates 34 and 36. The left pole piece shows a shading coil cast therein. The central laminations 38 are formed similar to laminations 14 wherein a pair of notches are spaced by a central tongue portion 38*a*. The outermost laminations 40 are also similar except that the tongue portion is omitted. Each pole face thus has a pair of spaced parallel grooves 46 and 48 extending parallel to the laminations, thus providing a continuous closed-loop rectangular path about the pole piece for receiving a shading coil 50 cast therein.

Figure 6:
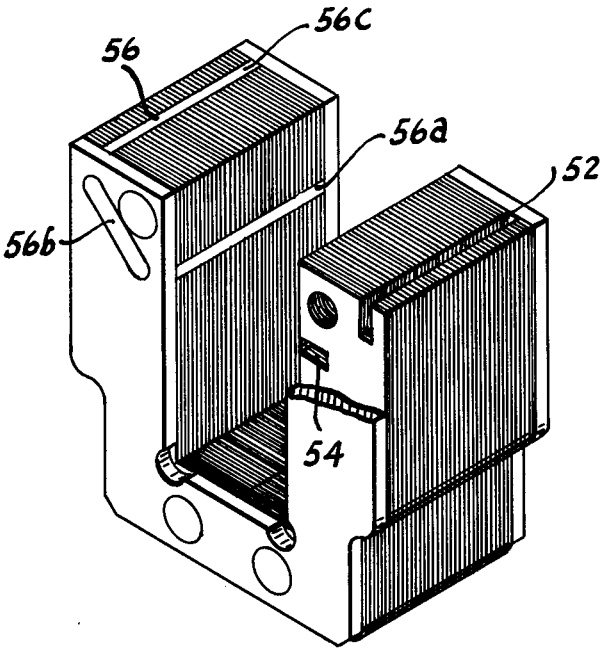
FIG. 6 is an isometric view, with one of the side plates partially cut away, of another alternate embodiment of a magnetizable core having another modified groove for the shading coil.

There is shown in FIG. 6 another alternate embodiment of the present invention wherein the grooves are formed on different surfaces of the pole pieces. A single groove 52 is formed on the pole face surface and another groove 54 is formed on a side surface of the pole piece. Diagonal slots are formed in the side plates internal to the edges thereof and in communication with the grooves to provide a continuous path for receiving a shading coil 56 comprised by the segments 56*a*, 56*b*, 56*c* and a segment like 56*b* (not shown) situate in the slot in the back side plate.

The present invention is not limited to the U-shaped laminated core shown herein, nor is it limited to the particular pole piece designs embodied therewith. The core need not be laminated nor must it be U-shaped. Moreover, numerous other pole piece designs are suitable for the concept of using a magnetizable core as a die for the casting of a shading coil therein. It is only necessary that there be a continuous path about a pole piece of the core.

DESCRIPTION OF THE PREFERRED METHOD

The core is formed by stamping out a plurality of laminations and then punching notches in each lamination as shown in FIG. 4. These laminations are then stacked between a pair of slotted side plates, with rivets extending therethrough.

The preferred casting method is one in which molten metal, such as zinc or lead, is injected into the slots and grooves and is solidified within a short time, on the order of tenths of a second. Referring to FIG. 2, flat backing members are held flush against the side plates and pole faces during injection to confine the molten metal therein. This method together with the abovedescribed core allows a shading coil to be permanently secured to the pole piece of the core in a single assembly step, eliminating the need for pre-formed coils and prior art affixation techniques and the extra assembly steps required therefor. The die-cast metal is mechanically interlocked with the core, thus avoiding bonding problems of an adhesive.

The short solidification time prevents molten metal flow into the cracks between the laminations on the pole face, thus preventing undesirable surface irregularities. However, as a result of repeated hammer blows by an armature, minute particles of the die-cast metal will tend to migrate into the cracks between the laminations on the pole face, thus providing a smoother surface to be engaged by an armature, thus further diminishing chatter and vibration. Other casting methods may be used which afford formation of an electrically conductive closed-loop coil.

I claim:

1. A laminated core assembly for an A.C. electromagnet having at least one pole face for engaging an armature, said assembly comprising a plurality of contiguously stacked magnetizable laminations flush at their ends to form said pole face, said assembly having a continuous closed-loop path therein receiving molten metal injected thereinto forming, when solidified, a cast in situ closed-loop shading coil, said coil having substantially uniform resistance due to the continuity of said metal throughout said path, at least a portion of said path extending across said ends of said laminations whereby at least a portion of said coil extends across said pole face such that minute particles of said solidified metal migrate into cracks between said laminations on said pole face after repeated engagements by said armature to provide a smoother pole face and increasing quietness of operation.

2. The laminated core assembly according to claim 1 also comprising a pair of side plates oppositely abutting the outermost of said laminations, each of said plates having a slot therein in communication with a pair of spaced grooves extending across said laminations to thereby form said path.

3. The laminated core assembly according to claim 2 wherein said grooves have a constricted configuration and said slots are internal to the edges of said side plates to thereby rigidly secure said coil in place.

4. The laminated core assembly according to claim 1 wherein said metal is zinc.

* * * * *